US005880072A

United States Patent [19]

Furey et al.

[11] Patent Number: 5,880,072

[45] Date of Patent: Mar. 9, 1999

[54] WEAR REDUCING COMPOSITIONS AND METHODS FOR THEIR USE

[75] Inventors: Michael J. Furey, Blacksburg, Va.; Czeslaw Kajdas, Plock, Poland

[73] Assignee: Virginia Tech Intellectual Properties, Inc., Blacksburg, Va.

[21] Appl. No.: 6,991

[22] Filed: Jan. 14, 1998

[51] Int. Cl.[6] ..... C10M 141/02; C10M 141/06; C10L 1/22; C10L 1/18

[52] U.S. Cl. ..... 508/263; 508/243; 508/268; 44/329; 44/338; 44/340; 44/353

[58] Field of Search ..... 508/243, 262, 508/263, 268; 44/338, 340, 353, 329

[56] References Cited

U.S. PATENT DOCUMENTS

| | | | |
|---|---|---|---|
| 3,180,832 | 4/1965 | Furey | 508/485 |
| 3,377,285 | 4/1968 | Randles | 508/243 |
| 4,185,965 | 1/1980 | Schlicht et al. | 508/255 |
| 4,402,844 | 9/1983 | Trepka | 508/243 |
| 4,539,127 | 9/1985 | Heiba et al. | 508/268 |
| 4,659,490 | 4/1987 | Louttan et al. | 508/268 |
| 4,840,741 | 6/1989 | Beltzer et al. | 508/267 |
| 5,034,143 | 7/1991 | O'Lenick, Jr. | 508/268 |
| 5,407,601 | 4/1995 | Furey et al. | 508/110 |

*Primary Examiner*—Jacqueline V. Howard
*Attorney, Agent, or Firm*—Whitham, Curtis & Whitham

[57] ABSTRACT

Compositions for reducing wear and friction of rubbing surfaces including mixtures of a cyclic amide and a monoester formed by reacting a dicarboxylic acid and a polyol in substantially equimolar amounts where the dicarboxylic acid is a dimer of an unsaturated fatty acid. The invention also relates to methods of use of such compositions.

32 Claims, 3 Drawing Sheets

WEAR REDUCING COMPOSITIONS AND METHODS FOR THEIR USE

BACKGROUND OF THE INVENTION

1. Field of the Invention

The invention is generally related to compositions for reducing wear of rubbing surfaces, wherein the compositions include a combination of a cyclic amide and a monoester formed by reacting a dimer acid with a polyol.

2. Description of the Prior Art

Wear has been defined as the progressive loss of a substance from the operating surface of a body as a result of relative motion at the surface of the body (see, Furey, "*Tribology", Encyclopedia of Materials Science & Engineering,* Pergamon Press, Oxford, pp. 5145–5157, 1986). When elements rub together, whether made of the same or different materials, wear can occur. The rate of wear tends to increase under harsh temperature and pressure conditions which, for example, exist inside ceramic or metal engines, propulsion engines, and the like. In addition to limiting the useful life of the part in which the ceramic or metal is used, wear of ceramics or metal can be costly because the ceramic or metals materials themselves are expensive to produce. Other significant problems associated with wear include, e.g., down time for equipment, reduced safety, and diminished reliability.

Therefore, lubrication, particularly under boundary friction conditions, is extremely important for rubbing materials. Lubrication is a process that reduces friction and/or wear (or other forms of surface damage) between relatively moving surfaces by the application of a solid, liquid, or gaseous substance (i.e., a lubricant). Therefore, the primary function of a lubricant is to reduce friction or wear or both between moving surfaces in contact. However, lubricants can also serve other ancillary functions, such as acting as a hydraulic fluid, coolant, gas seal and carrier for adhesives; they may also protect metal surfaces from corrosion and aid in the removal of debris and deposits. Examples of conventional lubricants are widespread and diverse. They include automotive engine oils, wheel bearing greases, transmission fluids, electrical contact lubricants, rolling oils, cutting fluids, preservative oils, gear oils, jet fuels, instrument oils, turbine oils, textile lubricants, machine oils, jet engine lubricants, air, water, molten glass, liquid metals, oxide films, talcum powder, graphite, molybdenum disulfide, waxes, soaps, polymers, and even the synovial fluid in human joints.

For instance, in the manufacture of small 4-stroke engines, such as used in lawn care equipment, it is customary to precoat certain parts (e.g., piston rings, cylinder, crankshaft bearings, cams) with special oils or greases prior to assembly, and then to carry out a short-time "hot test" of the engine using a normal charge of oil added to the crankcase. After the test, the normal charge of oil is then drained out using a suction device. However, some residual oil tends to remain in the engine. This represents not only an economic loss in terms of material and labor costs since large numbers of engines are involved, but also poses a possible leakage problem during shipping or upon first use in a particular application.

U.S. Pat. No. 3,377,285 to Randles teaches a nonthickening oil concentrate in which mineral oil additives containing an oil soluble ester copolymer are inhibited from increasing in viscosity or gelling by addition of a minor amount of a non-polymerizable nitrogen-containing heterocyclic compound having the

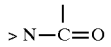

unit in the molecule.

U.S. Pat. No. 3,180,832 to Furey teaches lubricity and antiwear additives involving ester reaction products of substantially equimolar quantities of oil-soluble dimer acids with diols or polyols.

More recently, the environments where lubrication needs arise continue to evolve. For instance, in machinery, the classical lubricants and additives more typically have addressed applications involving rubbing parts made of metal, in particular, steel or its alloys. However, more recently there also has been increased interest in using ceramic materials and fiber-reinforced plastics (i.e., composites) in a wide variety of applications which traditionally have utilized metals. Ceramic and composite materials have several advantageous engineering properties. For example, ceramics generally can be used at much higher temperatures than metals, are relatively inert and resist corrosion, and are resistant to abrasive wear owing to their hardness. Additionally, some ceramics are lighter in weight than conventional steel-based materials. Alumina, silicon nitride, partially stabilized zirconia, and silicon carbide, for example, are ceramic materials being used in high temperature wear environments.

Ceramics thus have attracted increased interest for uses along side, in combination with, and/or in lieu of metals, such as in automotive engines, gas turbines, turbomachinery, cutting tools for super alloys, and aerospace bearings, which are driven by a need for industrial materials that can tolerate high temperature, corrosive environments and/or result in greater efficiency. However, the surface characteristics of ceramics are very different from those of metals. For these and other reasons, conventional metal lubricants generally have lacked the versatility for successful use in the lubrication of ceramics.

SUMMARY OF THE INVENTION

The present invention relates to antiwear compositions based on combinations of a cyclic amide and a monoester formed by reacting a dicarboxylic acid and polyol in substantially equimolar amounts, where the dicarboxylic acid is a dimer of an unsaturated fatty acid. The aforesaid compositions are useful for boundary lubrication of rubbing solid surfaces under severe conditions.

The term "rubbing" as used herein refers to solid surfaces in frictional contact with each other. The wear reduction achieved with cyclic amides is applicable to many types of solid surfaces in rubbing contact such as ceramics, metals, fiber-reinforced plastics, plastics, wood, composites, and the like. Also, the inventive mixture component of the dicarboxylic acid that is a dimer of an unsaturated fatty acid is occasionally referred to herein as the "dimer acid", for shorthand.

As has been discovered in experimental studies that are summarized herein, the combination of the cyclic amide with the aforesaid type of monoester yields total effects on antiwear and lubrication properties which far exceed the sum of the effects taken independently. This invention provides a composition which dramatically reduces wear while enjoying economic advantages of low cost and wide availability of ingredients and preparation materials.

Specific applications of the compositions of the present invention are widespread and diverse. The compositions can be used to reduce wear between mechanical parts in contact with each other, such as between gears, between a valve lifter and a cam of an automotive engine, and between a piston and cylinder in a motor. They also can be used in lubricating and reducing wear of bearings (e.g., steel bearings, ceramic bearings). The compositions also can be used in machining and cutting operations to reduce wear of a machining/cutting tool (ceramic or metal) used in a machining operation such as lathing, broaching, tapping, threading, gear shaping, reaming, drilling, milling, hobbing, grinding, turning operations, and the like.

The inventive compositions of the invention can be used as antiwear agents in automotive engine oil lubrication applications. For example, the compositions can be used in conjunction with or in place of conventional engine oil antiwear additives (e.g., zinc dialkyl dithiophosphate or "ZDDP") in liquid lubricating oils. In one specific embodiment, compositions of the invention can be applied to the lubrication of four-stroke engines, for instance, where the compositions are used to precoat critical engine parts, e.g., bearings, cams, pistons, during engine assembly. Also, the inventive compositions can be used in relatively small amounts during short duration testing of four-stroke engines in which the inventive composition is applied in small liquid coating amounts to engine parts sufficient to wet rubbing engine parts for the duration of the test. Alternatively, the inventive composition can be continuously introduced into the immediate vicinity of the engine parts during testing by vapor phase injection, without any standard liquid lubricating oil being added or needed in the engine during the test.

The inventive compositions also can be used as fuel lubricity and antiwear additives in combustion fuels, such as hydrocarbon fuels, including gasolines, aviation turbo fuel, jet fuel, rocket fuel (e.g., kerosene), and diesel fuels. The compositions can be added in effective amounts to the engine fuel itself such that a sufficient amount of unburned composition remains present in the cylinder during the engine cycle to lubricate and reduce wear between the piston and cylinder. For example, methods of the present invention can be applied to lubrication of gasoline engines, such as two-stroke engines, where the composition compounds of the invention can be used as a fuel additive to lubricate and reduce wear of rubbing and contacting engine parts during operation. The composition can be added directly to the engine gasoline, or to gasoline via a separate carrier fluid such as a lubricating mineral or synthetic oil to be added to the gasoline, to reduce engine wear. The lubricating compositions of the invention can be added to jet fuel to reduce fuel pump wear. The lubricating compositions of the invention also can be added to diesel fuel to control wear of diesel fuel injector pumps, where metal-to-metal contact occurs, while at the same time reducing exhaust emissions. The compositions of the present invention may be used as the sole additive in the fuel medium or in conjunction with other performance-enhancing additives added to the fuel, such as detergents, corrosion-inhibitors, alcohols (e.g., ethanol) or ethers (e.g., methyl-tertiary-butyl ether).

Other types of combustion engines where the inventive compositions are contemplated to be useful for wear reduction in rubbing engine parts include, for example, adiabatic or low heat-rejection engines in which ceramic components are employed, advanced propulsion systems using turbomachinery, and any engine or power-producing device in which hydrocarbon or fossil fuels are used as the source of energy.

The inventive compositions of this invention, where used as an antiwear additive for engine oils or fuels, offer an important advantage in that the ingredient compounds used are devoid of metals, phosphorus, or sulfur, which could lead to solid residues, soots, and deposits in a combustion chamber of an engine, or interfere with the action of emission catalyst systems (as is the case with additives containing metals and/or phosphorus). Additionally, the inventive compositions combust in ashless form such that there is an absence of ash or soot deposit formation. Furthermore, the inventive compositions, when combusted in a high temperature environment, such as in a combustion engine, form ashless, gaseous combustion products (e.g., $H_2O$, $CO_2$), and, as such, pose no threat to foul the catalyst in a catalytic converter and pose reduced environmental concerns.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
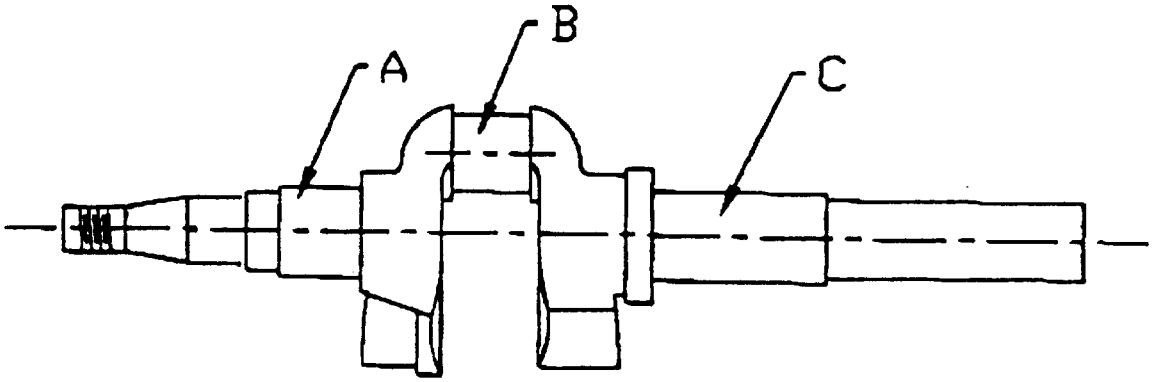
FIG. 1 is a schematic diagram of one of the critical assemblies requiring lubrication in a 4-stroke engine, i.e., the crankshaft, which was studied in the examples described herein.

The present invention involves compositions combining a cyclic amide and a monoester formed by reacting a dicarboxylic acid and polyol in substantially equimolar amounts, where the dicarboxylic acid is a dimer of an unsaturated fatty acid. In the examples described hereinbelow, the present invention is illustrated in terms of antiwear compositions combining a lactam and a partial ester of a dimer acid and short-chain glycol that provides outstanding protection against wear and surface damage when applied in very small quantities to rubbing surfaces, e.g., as in the production of engines. The inventive antiwear compositions are characterizable as organic tribochemical compositions. The use of such small or "minimalist" quantities of the inventive lubricating composition to pretreat surfaces to experience rubbing action offers advantages in material cost, labor, and environmental impact.

The cyclic amide ingredient of the inventive composition is a heterocyclic compound having the

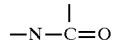

unit as part of the heterocyclic ring. Lactams are a preferred type of cyclic amide for use in the practice of this invention. A "lactam" is a cyclic amide produced from amino acids by the removal of one molecule of water. Lactams contemplated for use in this invention are represented by the following general formula I:

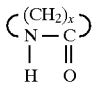

where x is a positive integer greater than or equal to 2, preferably ranging from 2 to 15, more preferably ranging from 4 to 11. The alkylene chain segments $-(CH_2)-$ of the molecule in formula I are indicated as saturated although it will be understood that any of the hydrogen atoms of one or more of the individual alkylene chain segments can be substituted as long as the added substituent does not interfere with or prevent the wear reducing effect of the overall blend. Similarly, the presence of an unsaturated bond between two carbons of the alkylene chain segment is acceptable as long as the same conditions are met.

In general, the alicyclic hydrocarbon chain segments $-(CH_2)_x-$ in formula I will undergo the same reactions as their open-chain analogs, viz., cycloalkanes undergo chiefly free-radical substitution, such as substitution of a hydrogen atom with a halide atom. For example, a halide atom could be substituted for a hydrogen atom in the $-(CH_2)-$ segment by reaction of the cyclic amide with $Cl_2$ (light catalyzed) or with $Br_2$ (with heating at about 300° C.). The presence of an unsaturated bond between two or more carbons of the alkylene chain segments in the Q group (i.e., $-(H_2C)=(CH_2)-$) is acceptable as long as the added unsaturated bond(s) does not interfere with or prevent the wear reducing effect desired of the cyclic amide compound. The nitrogen atom in Formula I should have a single hydrogen atom substituent, as shown. While not desiring to be bound to any particular theory at this time, it nonetheless is thought that the nitrogen atom should not be substituted with an alkyl group, aryl group, alkaryl group, and so forth type of substituent, because these types of substituents on the ring nitrogen could alter the polymer-forming potential or other possibly relevant chemical properties of the formula I compound when used at rubbing interfaces. Subject to the above provisos on any substituents on the ring carbons, the aforesaid lactams may be substituted or unsubstituted on the non-oxygenated carbon atoms by alkyl, aryl, alkaryl, aralkyl or cyclolalkyl.

Specific lactam compounds useful in the inventive blend include, as related to Formula I, 2-azetidinone where x=2, butyrolactam where x=3, 2-azacyclohexanone where x=4, caprolactam(2-oxohexamethyleneimine) where x=5, 2-azacyclooctanone where x=6, 2-azacyclononanone where x=7, and 2-azacyclotridecanone(laurolactam) where x=11.

Examples of molecular structures of suitable lactams for practicing this invention are shown by structures a–f hereinafter:

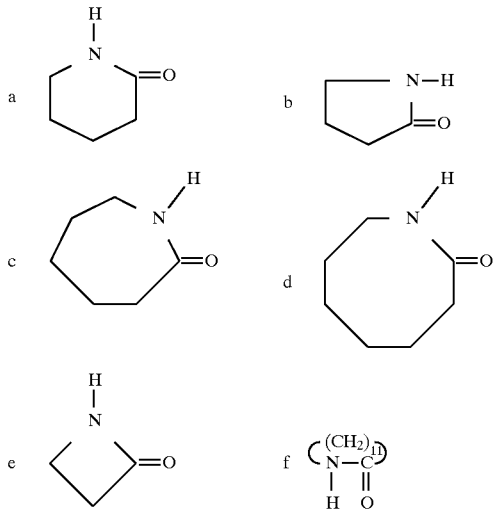

Referring to the above structures, structure a is 2-azacyclohexanone; structure b is butyrolactam; structure c is caprolactam' structure d is 2-azacyclooctanone; structure e is 2-azetidinone; and structure f is laurolactam.

Due to the substantial demand for lactams as raw materials in the production of a number of polyamides which are the polymers from which nylon fibers are made, a number of methods have been developed in the chemical industry for making these materials. Caprolactam(2-oxohexamethylenimine), shown in structure c above, is the most important raw material in the production of nylon 6. A large percentage of caprolactam is produced by the so-called cyclohexanone process where cyclohexanone is reacted with hydroxylamine to produce a cyclohexanone oxime intermediate followed by a Beckman rearrangement reaction to give caprolactam. Caprolactam also can be prepared by photonitrosation of cyclohexane or by nitrosation of cyclohexanecarboxylic acid in the presence of sulfuric acid, which technique is sometimes referred to as the "Toray Photonitrosation Process". Caprolactam can be hydrolyzed, N-alkylated, O-alkylated and subjected to many other reactions. Caprolactam is readily converted to high molecular weight, linear Nylon-6 polymer. On the other hand, through a complex series of reactions, caprolactam can be converted to the biologically and nutritionally essential amino acid L-lysine. Worldwide annual production capacity of caprolactam exceeds $3\times10^6$ tons. Therefore, caprolactam is readily available and its price is low in comparison with typical additives or even some more sophisticated lube oils.

Caprolactam is a white, hygroscopic, crystalline solid at ambient temperature. Caprolactam is very soluble in water and other polar and aromatic solvents; however, it is slightly soluble in high molecular aliphatic hydrocarbons. Caprolactam has a relatively low melting point to provide a stable, low viscosity melted state. The caprolactam, if supplied in powder form, can be added to the monoester described herein, and the combination gently heated to facilitate dissolution of the caprolactam.

Another lactam, ω-capric lactam, can be produced in a multi-stage process from decalin. The butadiene trimer cyclododecatriene can be converted to lactam $C_{12}$ with a first step involving epoxidation with paracetic acid or acetaldehyde monoperacetate to give cyclododecadiene monoepoxide. These examples of techniques to make lactams are not exhaustive, and one of ordinary skill will appreciate other known methods for making these compounds. Therefore, it is not believed necessary to elaborate further on the various well-known techniques for making lactam ingredients of the inventive compositions.

The other critical ingredient of the inventive composition pertains to the monoester compound derived from the dimer acid and polyol. In general, the monoester is made by esterification reaction of a dimer acid of a long chain dicarboxylic acid and a polyol. More preferably, the monoester is formed by reacting about one mole of $C_2$ to $C_5$ glycol with about one mole of a $C_{36}$ dicarboxylic acid dimer of a $C_{18}$ unsaturated fatty acid.

The dimer acid formed by dimerization of an unsaturated fatty acid preferably is a long-chain dicarboxylic acid with two alkyl side chains containing at least 9 carbon atoms between the respective carboxylic groups, more preferably the number of carbon atoms between the carboxylic groups ranges from about 12 to 42. The dimer acid preferably is a $C_{36}$ aliphatic, dibasic acid obtained by the dimerization of a $C_{18}$ unsaturated fatty acid. More preferably, the dimer acid is derived from linoleic acid; although other dimers are also encompassed such as dimers of oleic acid, and the mixed dimer of linoleic and oleic acids. Also, the dimers of dodecadienoic acid and the dimer of dicyclopentadiene dioic acid are also contemplated. Also, while the structure given below for linoleic acid is that of the 9,12-octadecadienoic acid isomer, this invention also encompasses the 9,11 isomer structure of linoleic acid as well, and combinations of these isomers.

Suitable formulations of dilinoleic acids for use in this invention are commercially available from Unichema Ltd. Company under the trade name EMERY 1010, or under the trade name EMPOL dimer acids from Henkel in various grades of dimer acid purity relative to trimer and monobasic content.

While the invention is described using a dimer acid, it is understood that the dimer acid is not necessarily 100% dimer acid, as many commercially available dimer acid compositions also will often contain amounts of trimer and monomer acids. For example, commercially advertised EMPOL dimer acids include a wide variety of products in which dibasic acid content can vary from about 75% to 95% by weight. Several non-limiting examples of suitable EMPOL dimer acid-containing products include EMPOL 1004 (79 wt % dimer acid, 5 wt % monomer acid, 16 wt % trimer acid), EMPOL 1061 (94 wt % dimer acid, 3.5 wt % monomer acid, 2.5 wt % trimer acid), EMPOL 1026 (82 wt % dimer acid, 7 wt % monomer acid, 11 wt % trimer acid), EMPOL 1020 (77 wt % dimer acid, 12 wt % monomer acid, 11 wt % trimer acid), and EMPOL 1040 (22 wt % dimer acid, 2 wt % monomer acid, 76 wt % trimer acid). It is preferred that the dimer acid source composition contain the dimer acid as its predominant ingredient by weight, and more preferably about or above 75% by weight dimer acid.

The Diels-Alder reaction is useful for synthesizing the dimer acid by dimerization of a long chain unsaturated fatty acid. This reaction is conducted at the reflux temperature in an appropriate solvent for the reactants, such as toluene, and an appropriate catalyst, such as p-toluene sulfonic acid.

The polyol reactant used in the esterification reaction of the dimer acid preferably is selected from oil insoluble glycols such as alkane diols and oxa-alkane diols, straight chain or branched. The alkane diol preferably has from about 2 to 8 carbon atoms, more preferably 2 to 5 carbon atoms in the molecule. Examples include ethylene glycol, 1,4,-butane diol, and propylene glycol, and the like. The oxa-alkane diol can have 4 to 100 carbon atoms with periodically repeating groups of

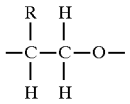

where R is H or methyl. For example, the oxa-alkane diol can be 4-oxa-heptane diol-2,6.

The molar quantities of the dimer acid and the polyol reactants used in the esterification reaction scheme to synthesize the monoester are adjusted appropriately so as to secure a partial ester product, viz., a monoester. Namely, the reaction is conducted substantially equimolarly to provide a monoester product. The general reaction equation for synthesis of the monoester from the dimer acid and a polyol (viz., a glycol or diol) is represented in reaction scheme 1, which is as follows:

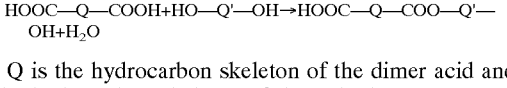

$$HOOC—Q—COOH+HO—Q'—OH \rightarrow HOOC—Q—COO—Q'—OH+H_2O$$

where Q is the hydrocarbon skeleton of the dimer acid and Q' is the hydrocarbon skeleton of the polyol.

While some small amount of inadvertent complete diester compound can be tolerated in the product, its amount should not exceed 10 wt %, and preferably constitutes less than 1 wt %, of the total reaction product(s) with the balance constituted by the desired monoester product. Broadly speaking, there may be present about 0.8 to 1.2 molar proportions of the polyol reactant per molar proportion of the dimer acid reactant in the esterification reaction.

The monoester product derived from the esterification reaction of the dimer acid with the polyol is then physically blended with the cyclic amide to formulate the inventive antiwear composition. The inventive antiwear compositions involving the blend of the monoester and the cyclic amide may be used as a binary mixture consisting exclusively of the cyclic amide and monoester components, or as dissolved, partly dissolved, or dispersed, in a carrier medium. From a practical standpoint, the carrier medium should be a flowable in nature. An antiwear composition of the invention generally contains a molar ratio value of moles monoester/moles cyclic amide ranging from 0.4 to 1.8, respectively. Preferably, the composition of the invention contains a molar ratio value of moles monoester/moles cyclic amide ranging from 0.8 to 1.2, respectively. The mixture can be used as an additive alone (an undiluted mixture), or, alternatively, as dispersed or dissolved in other media.

The preferred mixing amounts of monoester and cyclic amide can vary when based on a weight/weight basis, depending on the particular compounds involved. For example, for a mixture of caprolactam and a monester of derived from reacting a $C_{36}$ dimer acid and ethylene glycol, the mixture preferably contains about 10 to about 30 wt. % caprolactam, and about 90 to about 70 wt. % monoester, and, more preferably, the mixture contains about 20% wt. caprolactam and about 80 wt. % monoester.

For ease of use or to save in material costs, the inventive monoester and cyclic amide mixture composition can be dispersed or dissolved in a fluid carrier medium in some environments. The term "fluid" means any material or substance that changes shape or direction uniformly in response to an external force imposed upon it. The term can apply not only to liquids, but also to gases and even to finely divided solids. For example, the region of rubbing contact (i.e., the interface) between a first solid part and a second solid part can be flooded with, immersed in, or exposed to the lubricating carrier medium (e.g., liquid, gas, semi-solid) containing the composition.

In any case, the blend of monoester and cyclic amide should be mixed completely to provide a uniform, or at least a substantially uniform, dispersion of the critical two components throughout the resulting mixture. This thorough mixing of the cyclic amide and monoester must occur before a binary mixture of the ingredients is used by itself or as dispersed into a gaseous or semi-solid carrier medium, or, alternately, if dispersed in a liquid carrier medium, mixing of the critical ingredients can be affected after introduction into the liquid carrier medium.

If a liquid carrier medium is used, it can be organic or aqueous. The liquid carrier can be a hydrocarbon material such as hydrocarbon solvents, mineral oils, vegetable oils, synthetic oils, liquid petroleum distillates and refined products therefrom, long chain $C_{10}$ to $C_{20}$ saturated alkanes, and polyalkylene glycols. Non-limiting examples are provided below for these classes of hydrocarbons.

Mineral oils can be petroleum-based types such as aliphatic or wax-base (Pennsylvania), aromatic or asphalt-base (California) or mixed-base (Midcontinent U.S.A.). The mineral oils also can be petroleum-derivatives such as engine oil lubricants, machine oil lubricants, and cutting oil lubricants. The vegetable oils can be linseed oil, tung oil, soybean oil, castor oil, and palm oil. The synthetic oils can be diesters, sebacates, ethoxylates, and the like. The liquid petroleum distillates and refined products therefrom can be gasoline, kerosene, fuel oils, gas oil and lubricating oils. The long chain saturated alkanes can be, for example, n-hexadecane ($C_{16}H_{34}$; cetane). The polyalkylene glycols can be polyethylene glycols.

The inventive composition generally can be contained in a liquid carrier in any amount which is adequate to impart wear and/or friction reduction effects, which can be empirically assessed such as by tests described herein.

For use as antiwear and lubricity additives in fuels (e.g., diesel fuel, jet fuel, gasoline), the monoester/cyclic amide composition of the invention can be used at concentrations ranging from 0.001 to 0.4% by weight, preferably 0.01 to 0.1 wt %. For diesel fuels, a concentration of 50 to 200 ppm the monoester/cyclic amide composition is preferred. For jet fuels, a concentration of 0.05 to 0.2 wt % of the monoester/cyclic amide composition is preferred.

For use as antiwear and antifriction additives in lubricating oils (e.g., mineral oils and synthetic oils), the monoester/cyclic amide composition of the invention can be used at concentrations ranging from 0.01 to 10% by weight, preferably 0.1 to 4 wt %.

For use as oil concentrates for special applications (e.g., precoating piston rings and cylinders in small engine production), the monoester/cyclic amide composition of the invention can be used at concentrations ranging from 10 to 80% by weight in an oil carrier, preferably 20 to 60 wt %.

For use in pure and high concentration forms for special, extremely severe manufacturing operations (e.g., pretreating various engine bearings, cams in 4-stroke engines production), the monoester/cyclic amide composition of the invention can be used at concentrations ranging from 75 to 100% by weight.

A gaseous form of carrier fluid can be air, nitrogen, gaseous combustion fuels, and hydrocarbon combustion product gases, and the like. Vapors are included within the scope of the term gas. For instance, vapors of liquid hydrocarbon fuels (e.g., gasoline, diesel fuel) can be used as a carrier for the inventive composition. The lubricating gaseous compositions can contain the critical blend of cyclic amide and monoester in relatively dilute amounts.

Higher concentrations of the inventive composition may also be useful in the gaseous phase, with the upper concentration limits being those which would produce saturated vapor at a given pressure and temperature. The lower limit on the concentration of the inventive composition in the carrier gas generally will be that amount on the contacting region of the rubbing surfaces, whether ceramic, metal and/or composite materials, which is adequate to impart wear and/or friction reduction effects, which can be empirically assessed such as by tests described herein.

The inventive composition may be introduced into the carrier gas in a number of different ways, for example:

(a) heating the composition externally to form a vapor and then introducing the vapor into a flowing stream of inert gas (e.g., nitrogen);

(b) injecting the inventive composition in liquid form into a stream of carrier gas so that vaporization thereof will occur. For example, the monoester/cyclic amide composition can be injected in liquid form into a stream of air to atomize the inventive composition and form a vapor or mist. This vapor or mist can be delivered to: (i) diesel engine compression chambers; (ii) gasoline engine compression chamber with a fuel injection system; (iii) any type of engine designed to operate at high temperatures (e.g., engines with metal and/or metal alloy parts, and also adiabatic or low heat-rejection engines using ceramic components);

(c) dissolving the inventive composition in a hydrocarbon carrier liquid and then injecting the resulting liquid composition in liquid form into a stream of carrier gas so that vaporization thereof will occur;

(d) vaporizing carrier liquids (e.g. fuels) containing dissolved inventive composition to generate a vapor containing inventive composition, which vapor is conducted to a rubbing contact site; and (e) any technique of adjusting pressure and temperature of the inventive composition and carrier gas which results in the inventive composition being present as a vapor in the mixture. These modes of gas phase application of the inventive composition are applicable to any of ceramic, composite, and metal surfaces, especially those operated at high temperatures.

The temperature of the carrier gas and inventive composition can be regulated, for example, by passing the carrier gas through a heated flask or vessel containing liquid inventive composition that is being volatized by application of heat under thermostatic control; once the carrier gas picks up volatized inventive composition vapor in the flask it can be transmitted by conduits/tubes to a tube opening positioned proximate the contacting (rubbing) region of the surface or surfaces in contact. The inventive composition can be delivered to the surface areas of one or both of the solid bodies where rubbing will occur or is occurring between the two (or more) solid bodies. The actual compound vapor delivery temperatures to be used in practice will depend on the desired final vapor concentrations as well as the vapor pressure-temperature properties of the selected antiwear/anti-friction compound. For example, a lower molecular weight, lower boiling point compound can be introduced as a vapor at a lower temperature than a higher molecular weight compound. Measurements of vapor flow, weight change of the vapor source, or vapor concentration can be made in order to regulate the desired vapor concentration. It has generally been found that delivering the vapor at a higher temperature is preferred.

It should be appreciated that the inventive composition can be dispersed or dissolved in a carrier medium primarily for reduction of material costs. However, it is also possible to use the inventive composition without dissolving or dispersing the inventive composition in a carrier fluid. For instance, inventive composition fluids per se can be heated to increase the vapor pressure and provide a vapor of the compound. Alternatively, the inventive composition compounds can be injected in liquid form directly into an engine compression chamber during the compression cycle whereby vaporization of the compound occurs.

The inventive composition also can be dispersed in a semi-solid carrier medium, such as hydrocarbon grease, silicone grease, or wax. The inventive composition generally can be contained in the semi-solid carrier in higher concentrations, if desired, because of diminished solubility concerns. The inventive composition generally is contained in a semi-solid medium in an amount of about 0.5% or more up to about 99%, by weight, depending on the use.

The inventive composition also can be present in a carrier in conjunction with other additives commonly used in the particular environment at hand. To form a finished oil, an oil carrier may contain conventional oxidation inhibitors, rust inhibitors, detergents, pour point depressants, viscosity index improvers, stabilizers, and so forth. Also, where the inventive composition is used as a lubricity additive for an engine fuel, the engine fuel can also contain other additives used to improve engine performance (e.g., dispersants, antioxidants, corrosion-inhibitors, haze inhibitors, stabilizers, antistatic agents), and so forth.

The primary function of the carrier medium, if used, is to facilitate transport of the inventive composition onto the surface of the ceramic, metal, or other type of element in rubbing contact. Any carrier fluid capable of such inventive composition dissolution or dispersion, and transport, is deemed to be within the scope of the invention as long as it does not react chemically with the inventive composition in the bulk fluid. That is, the carrier fluid, whether liquid, gas, or semi-solid, cannot react with and is thus inert, in a limited sense, relative to the inventive composition and it plays no part in the inventive compositions' function other than to assist in their delivery to designated contacting regions on rubbing surfaces needing lubrication, thus "carrying" the additives in the liquid, gas or semi-solid phase.

It is also to be understood that the carrier medium liquids or gases will be selected on the basis of providing proper volatility, boiling point, chemical reactivity, and so forth, to fulfill the functions needed by the inventive composition and also any functions separately required of the carrier liquid itself (e.g., engine oils, engine fuels).

The antiwear compounds and dispersions or dissolved solutions of same can be precoated on surfaces prior to rubbing and/or introduced to the rubbing interface during contact.

The substrates that can be lubricated and experience wear reduction by the inventive composition are not particularly limited, and include, for example, ceramics, metals, composites, plastics, and wood, or combinations thereof. The rubbing surfaces involve two (or more) contacting surfaces of solid materials. The contacting surfaces can be in relative motion to each other. For example, confronting surfaces of two separate solid bodies can both be moving in sliding contact over one another, or alternatively, one surface can be stationary while another surface of another body is set in motion to slide in contact over the surface of the stationary body. Also, the inventive method can be used to lubricate a plurality of metal surfaces in rubbing contact, a plurality of ceramic surfaces in rubbing contact, or both a metal surface and a ceramic surface in rubbing contact.

Metals that can be lubricated by the invention, include, for example, steel, alloy steels, alloy cast iron, aluminum alloys, titanium alloys and other advanced high strength, high temperature metallic alloys. Ceramic materials that can be lubricated by the present invention include, for example, alumina, zirconia, silicon nitride, silicon carbide, boron nitride, aluminum nitride, boron carbide, beryllia, and combinations thereof. Polymer matrix composites (e.g., carbon fiber/epoxy, glass fiber/nylon, carbon/polyether ether ketone, and high temperature polymeric composites) also can serve as substrates to be lubricated by the invention.

Other tribological applications and advantages of the inventive pre-treatment techniques and composition are also contemplated, e.g., machining, cutting, and metalworking. Furthermore, pre-treatment of certain components (e.g., engine parts) during an initial test run may perpetuate into lasting benefits and improved performance during subsequent operation of the device, machine, or engine by the user since the protective films formed on the regions of rubbing contact may exhibit significant adhesion and durability.

The following non-limiting examples will further illustrate the present invention. All parts, ratios, concentrations, and percentages are based upon weight unless otherwise specified.

EXAMPLES

Engine tests and high contact stress laboratory pin-on-disk tests were conducted to establish that there is a striking synergistic action between the dimer acid/ethylene glycol monoester and caprolactam in wear tests at ambient and elevated temperatures. These studies are summarized in the examples herein.

Materials Preparation

The following protocol was followed to prepare the lubricating compositions to be tested.

A composition combining caprolactam and a monester derived from a $C_{36}$ dimer acid and ethylene glycol, in the proportions by weight as indicated hereinafter, was prepared by gentle heating to 120° F. (49° C.) and stirring for 1 hour. The resultant composition was a clear, viscous, amber-colored fluid. It was found that shorter blending times are sufficient at higher temperatures, depending on the caprolactam concentration.

The particular monoester derived from reacting a $C_{36}$ dimer acid and ethylene glycol, as used in the examples described herein, was synthesized according to the following reaction scheme 2:

Reaction Scheme 2

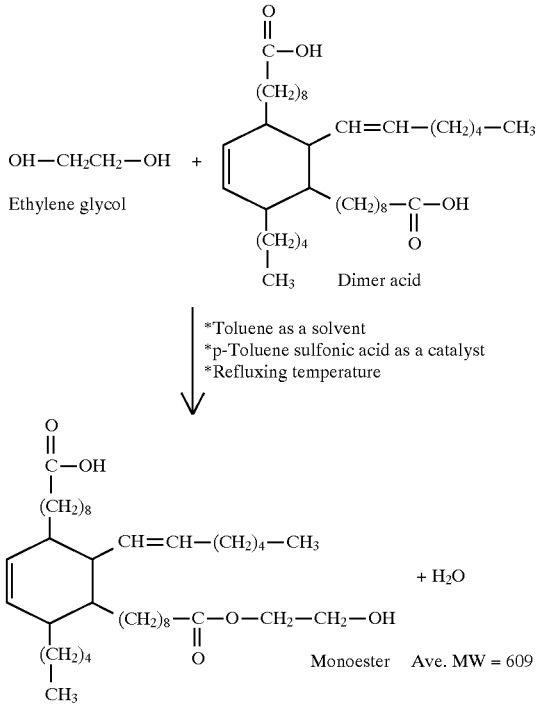

Equimolar quantities of EMERY 1010 containing a dimer of linoleic acid (1200 g) and ethylene glycol (125 g) were introduced to a three-neck flask. The EMERY 1010 $C_{36}$ dimer acid formulation contained 94 wt. % dimer of linoleic acid, and it was obtained from Unichema Ltd. Company. Next, toluene (2.5 liters) was added as a solvent and p-toluene sulfonic acid (2 g) as a catalyst. The flask was equipped with a heating chamber, stirrer, thermometer, a reflux-type condenser, and a system for collecting a measured (theoretical) amount of water released during reaction. Then the mixture was heated at boiling temperature (i.e., approximately 120° C. and for about 2½ hours) to strip off the diluent solvent. After collecting about 30 ml of water (reaction molar amount equals 36 ml of water), the reaction was stopped and the mixture was cooled down to 40°–50° C. The mixture was water washed (500 ml) followed by filtration in order to remove catalyst. Raw monoester/toluene blend was heated under mild vacuum and with nitrogen flowing through the flask in order to remove the solvent (i.e., toluene). The acid number of the obtained monoester was analyzed. The required theoretical acid number was calculated to be 92.5, while the measured actual value was 92, so the partial ester product was a relatively high purity monoester. The molecular weight of the monoester product was determined to be 609.

The caprolactam used in these examples was obtained from Eastman Kodak Company, CAS #105-60-2 (Practical Grade). It was a white crystalline solid at room temperature, having a molecular weight of 113.16, and a melting point of 70° C. The structure of the caprolactam is shown as structure "c" above.

To demonstrate the effectiveness of pre-treatment lubricating methods using compositions of this invention, the following tests were conducted.

Three sets of tests were carried out to evaluate the tribological performance of our compositions, namely:

(a) An initial exploratory series of small 4-stroke engine tests using a mulching machine to supply the load and speed control (b) A second series of 16 engine tests carried out on a production line using 4-stroke engines similar to those in (a) above.

(c) High load pin-on-disk tests using a steel-on-aluminum system. This was used as a representation of a metallurgical combination similar to one critical engine lubrication area (i.e., the connecting rod bearing).

The key results of these three sets of tests are summarized in the following sections.

Example 1

4-stroke engine tests were conducted using a set-up consisting of a Tecumseh 4-stroke engine Model Type TVS115 made by Tecumseh Products Company, New Holstein, Wis., connected to a Murray mulching machine with speed control, temperature measurement, and data acquisition capabilities. The TVS115 engine had the following specifications: 5 HP power; 11.32 $in^3$ displacement; 1.844 inch stroke; 2.795–2.796 inch bore; 2.790–2.791 inch diameter; 0.9985–0.9990 inch crank shaft magneto main bearing diameter; 0.9985–0.9990 inch crank shaft power takeoff main bearing diameter; 0.8620–0.8625 inch connecting rod diameter; 0.475–0.4980 inch diameter cam shaft bearing; and 630 ml engine oil capacity. The engine manufacturer recommended SAE 30 weight crankcase oil for use in this engine, except for engine operation at below 32° F. ambient where 5W30 was recommended.

A series of exploratory tests were carried out to determine the feasibility of pre-treatment, fuel lubricity additives, and vapor phase lubrication as approaches to eliminating crankcase oil in short-duration runs in a 4-stroke engine. In each case, a new engine was used after disassembly, making necessary measurements, taking photographs of key components, carrying out the pre-treatment procedure, and re-assembly for testing.

Prior to conducting each test, every engine was disassembled and the components soaked in naphtha solvent bath for about 4 hours to get rid of the factory oil. After cleaning the engine parts, measurements of the cams and the connecting rod bushing half were made and later compared with the measurements of the same taken after the test. The different bearings, cams and piston-cylinder interface were coated with the selected experimental lubricant using either a brush or a stick. The fuel contained additives at 2% concentration and was stirred for 5 to 10 minutes to enhance the solubility of the additives. The engine was assembled using a torque wrench to apply the necessary torque on the bolts, as mentioned in the service manual. The engine was then mounted on a Murray mulcher with the blade mounted on; this accounted for the applied load. The engine was then run for about 2–3 minutes at a speed of about 3000 rpm. Using this procedure, several engine tests were carried out to determine the feasibility of our approach using various combinations of engine component pre-treatment, fuel lubricity additives, and vapor phase lubrication. It was demonstrated that an engine could be run for as long as 5 minutes and more without adding any oil to the crankcase. The goal was one minute of satisfactory operation.

As an example, tests 1 and 2 were carried out using a monoester/caprolactam combination for pre-treatment and a fuel additive mixture containing this combination plus diallyl phthalate. The results are summarized in Table 1 and they show that the engine was in excellent condition after the tests which ranged from 1 minute to a little over 3 minutes. There were no signs of wear or damage.

In another test (Test 3), a somewhat more robust and more powerful (5.5 hp) engine of the same general type (viz., an engine model Tecumseh VLV 55) was used and run at a higher speed (i.e., 3500 rpm) for increased severity of operation. In this case, the pre-treatment of the piston-cylinder interface was made with a 50% solution of the monoester/caprolactam combination in a mineral oil (viz., Mobil 300N oil). This was also used at 2% concentration in the fuel. The main bearings were coated by brush with a thin film of the pure monoester/caprolactam mixture while the connecting rod bearing was treated with 1% of the monoester/caprolactam combination in a commercial grease containing molybdenum disulfide. As can be seen by the data in Table 1, the condition of the engine after this testing also was excellent.

TABLE 1

| | | Engine Pre-Treatment | | | | Test Conditions | | |
|---|---|---|---|---|---|---|---|---|
| Test No. | Engine Model | Piston/Cylinder Bearings | Main Bearing & Cam | Connecting Rod Bearing | Fuel Additive? | Time (sec) | Speed (RPM) | Max Temp. C(e) |
| 1 | TVS115 5 HP | 1% Monoester 0.2% Caprolactam in SAE 30 oil | 1% Monoester 0.2% Caprolactam in MOLY EP grease(a) | 1% Monoester 0.2% Caprolactam in MOLY EP greese(a) | Yes(c) | 190 | 3000 | 67 |
| 2 | TVS115 4.5 HP | 80% Monoester 20% Caprolactam | 80% Monoester 20% Caproiactam | 80% Monoester 20% Caprolactam | Yes(c) | 60 | 3000 | 48 |

TABLE 1-continued

| | | | | | | | | |
|---|---|---|---|---|---|---|---|---|
| 3 | VLV55 5.5 HP | 40% Monoester 10% Caprolactam 50% Mobil 300 N oil(b) | 80% Monoester 20% Caprolactam | 0.8% Monoester 0.2% Caprolactam In MOLY EP grease(a) | Yes(d) | 60 | 3000 | 44 |

| Test | Wear Measurements: CAM Wear (inches) | | C.R. Bushing Weight | |
|---|---|---|---|---|
| No. | Upper | Lower | Loss (gms) | Remarks |
| 1 | 0.00016 | 0.00 | 0.001 | Appearance and condition of the engine components after the test was excellent. |
| 2 | 0.002 | 0.0006 | 0.0005 | Post-test engine condition was excellent. |
| 3 | 0.0067 | 0.001 | 0.00 (No change) | Post-test condition of all engine components was excellent. |

(a) UNILUBE Industrial MOLY EP Grease, manufactured by Coastal Unilube, Inc., a subsidiary of Coastal Corporation, West Memphis, AR 72303
(b) A product of Mobil Oil consisting of a paraffinic type neutral mineral oil containing no additives and having a kinematic viscosity of 7.31 cSt at 100° C. and 53.12 cSt at 40° C. The Viscosity Index is 96 and the API gravity is 29.0.
(c) 2% concentration in fuel: 0.2% Monoester, 0.1% Caprolactam, 0.2% Diallyl Phthalate, 1.5% Mineral Oil (white, heavy).
(d) 2% concentration in fuel: 0.8% Monoester, 0.2% Caprolactam, 1.0% Mobil 300N.
(e) From thermocouple located at the beginning of the guide space close to inner cylinder wall and below lower position of piston; away from combustion region where temperatures would be much higher.

Based on the above preliminary studies of tests 1–3, it was demonstrated that it was indeed possible to run short-term "hot tests" in the subject 4-stroke engines without adding oil to the crankcase. These tests show it is possible to accomplish excellent performance by using less than 10 g, and usually only 4 to 6 g, of the inventive lubricating composition for pre-treatment of 4-stroke engines during engine testing. This represents a decrease of approximately 100-fold from conventional treatments involving starting with 500 g of lubricant and leaving 30–90 g in the engine after engine testing and test oil drainage of the crankcase oils used. There is no need to either add oil or to remove it after engine tests with the pre-treatment method. Furthermore, vapor phase lubrication did not appear to be necessary or important for this particular application. The next step was to test the invention on a production line in real time and with several engines. This testing phase is described in the next section.

Example 2

Sixteen engine tests were conducted on 4-stroke Tecumseh Engine Model TVS 115 made by Tecumseh Products Company, New Holstein, Wis., having the same specifications as defined in Example 1 above. The tested engine assembly is shown in FIG. 1, where A represents the crank shaft main bearing (upper), B represents the connecting rod-crank bearing, and C represents the crank shaft main bearing (lower).

Tables 3A, 3B and 3C below indicate which engine parts were pretreated with the specific lubricating compositions designated as Lubricants A, B and C, which are described in Table 2.

TABLE 2

| Lubricant | Composition (wt %) |
|---|---|
| A | 80% Monoester, 20% Caprolactam |
| B | 40% Monoester, 10% Caprlactam, 50% Mobil 300N[(a)] |
| C | 0.8% Monoester, 0.2% Caprolactam, in MOLY EP Grease[(b)] |

TABLE 2-continued

| Lubricant | Composition (wt %) |
|---|---|

[(a)]A product of Mobil Oil consisting of a paraffinic type neutral mineral oil containing no additives having a kinematic viscosity of 7.31 cSt at 100° C. and 53.12 cps at 40° C. The Viscosity Index is 96 while the API gravity is 29.0.
[(b)]UNILUBE Industrial MOLY EP Grease, manufactured by Coastal Unilube, Inc., a subsidiary of Coastal Corporation, West Memphis, AR 72303.

The engine bore and piston/piston rings of each test engine was coated with Lubricant composition B and the cams and cam shaft bearing were pretreated with Lubricant composition B. The pre-treatment was done using a brush or a stick, where necessary. The approximate amount of Lubricant used at each interface for the 16 tested engines is given in the Tables 3A–3C.

TABLE 3A

| Engines 1–12 | | |
|---|---|---|
| Lubricant | Engine Interface Pre-Treated | Approximate Amount of Lubricant Used (g) |
| A | Main bearings, cams, camshaft bearing | 2.0 |
| B | cylinder, piston-piston rings | 3.0 |
| C | connecting rod bearings | 1.0 |

TABLE 3B

| Engines 1–12 | | |
|---|---|---|
| Lubricant | Engine Interface Pre-Treated | Approximate Amount of Lubricant Used (g) |
| A | Cams, camshaft bearing | 0.5 |
| B | Cylinder, piston-piston rings | 3.0 |

TABLE 3B-continued

| Engines 1–12 | | |
|---|---|---|
| Lubricant | Engine Interface Pre-Treated | Approximate Amount of Lubricant Used (g) |
| C | Main bearings, connecting rod bearing | 2.0 |

TABLE 3C

| Engines 15–16 | | |
|---|---|---|
| Lubricant | Engine Interface Pre-Treated | Approximate Amount of Lubricant Used (g) |
| A | Main bearings, connecting rod bearings, cams, camshaft bearing | 2.5 |
| B | Cylinder, piston-piston rings | 3.0 |

The amount of lubricant used at the different interfaces, as given in the Tables 3A–3C, all pertain to Tecumseh TVS 115 engines. Larger engines with higher HP would be expected to require greater quantities of the lubricants.

The average calculated film thicknesses for the bearing regions were found to be 0.023 inches for the crank shaft main bearing, 0.022 inches for the connecting rod-crank bearing, and 0.022 inches for the crank shaft main bearing.

Test Procedure

After each engine is assembled in a production line, it moves towards the end of the production line where the engine test run is conducted. At this point the shroud does not contain the starter housing. The engine is clamped on to the test stand and is loaded by means of a belt going around a clamp mounted on the flywheel bowl. The testing procedure consists of two cycles. The engine is run until the speed touches 3500 rpm; when the speed is adjusted to 1900 rpm the engine is stopped. It is then run again till it reaches the same upper limit and when the speed is once again adjusted to 1900 it is finally stopped. The time taken to complete this test run varies from one engine model to another as well as by the HP rating. Each of the sixteen engines was run approximately for 40–60 seconds in this example.

Ten of the sixteen engines were run using an additive in the fuel. Namely, engines 1–6 and 13–16 also had 2 wt % of Lubricant included as a fuel additive in addition to the engine lubricants applied as described in Table 3. A separate gasoline tank was used to store and supply this fuel (with additive) to these 10 pre-selected engines.

After completion of the sixteen engine tests, the engines were dismantled and placed in separate boxes for inspection. The engine parts were cleaned using alcohol and photographs were taken of the different interfaces, viz. main bearings, Connecting Rod (C.R.)-crank bearing, piston, C.R. bushing halves, cylinder etc. The condition of the engine components and interfaces of the engines revealed impressive maintainence of surface condition and lack of wear. Only some minor scoring on the C.R. bushing halves of engine nos. 3, 5 and 8 was particularly noteworthy. A summary of the post test condition of the engine components of the sixteen tests is provided in Tables 4A–4C. These results are spread over three separate tables merely for sake of convenience.

TABLE 4A

| | Engine Component Pre-Treatment[a] | | | | | Post-Test Engine Condition[c] | | | | | |
|---|---|---|---|---|---|---|---|---|---|---|---|
| Test | Main Bearings | C.R. Bearings | Cams, Camshaft | Piston Cylinder | Fuel Additive?[b] | Main Bearing (top) | C.R. Crank Bearing | C.R. Bushing Halves | Cams | Piston | Cylinder |
| 1 | A | C | A | B | YES | **** | **** | **** | **** | **** | ** |
| 2 | A | C | A | B | YES | **** | **** | **** | **** | **** | *** |
| 3 | A | C | A | B | YES | ** | **** | *[d] | **** | **** | *** |
| 4 | A | C | A | B | YES | **** | **** | **** | **** | **** | *** |
| 5 | A | C | A | B | YES | **** | **** | **** | **** | **** | **** |
| 6 | A | C | A | B | YES | **** | **** | *[d] | **** | **** | *** |

[a]Lubricants as described in Table 2.
[b]2 wt. % Lubricant B in fuel.
[c]Ratings: **Excellent; *Very Good; **Good; *Fair
[d]Slight evidence of beginning of scoring on the C.R. Bushing (Al alloy) half.

TABLE 4B

| | Engine Component Pre-Treatment[a] | | | | | Post-Test Engine Condition[b] | | | | | |
|---|---|---|---|---|---|---|---|---|---|---|---|
| Test | Main Bearings | C.R. Bearings | Cams, Camshaft | Piston Cylinder | Fuel Additive? | Main Bearing (top) | C.R. Crank Bearing | C.R. Bushing Halves | Cams | Piston | Cylinder |
| 7 | A | C | A | B | NO | **** | **** | **** | **** | **** | **** |
| 8 | A | C | A | B | NO | **** | **** | **** | **** | **** | *** |
| 9 | A | C | A | B | NO | **** | **** | ***[c] | **** | **** | ** |
| 10 | A | C | A | B | NO | **** | **** | **** | **** | **** | *** |
| 11 | A | C | A | B | NO | **** | **** | **** | **** | **** | **** |
| 12 | A | C | A | B | NO | **** | **** | **** | **** | **** | *** |

TABLE 4B-continued

| | Engine Component Pre-Treatment[a] | | | | | Post-Test Engine Condition[b] | | | | | |
|---|---|---|---|---|---|---|---|---|---|---|---|
| Test | Main Bearings | C.R. Bearings | Cams, Camshaft | Piston Cylinder | Fuel Additive? | Main Bearing (top) | C.R. Crank Bearing | C.R. Bushing Halves | Cams | Piston | Cylinder |

[a]Lubricants as described in Table 2.
[b]Ratings: **Excellent; *Very Good; **Good; *Fair
[c]Slight evidence of beginning of scoring.
[d]Best overall condition of all engine components.

TABLE 4C

| | Engine Component Pre-Treatment[a] | | | | | Post-Test Engine Condition[c] | | | | | |
|---|---|---|---|---|---|---|---|---|---|---|---|
| Test | Main Bearings | C.R. Bearings | Cams, Camshaft | Piston Cylinder | Fuel Additive?[b] | Main Bearing (top) | C.R. Crank Bearing | C.R. Bushing Halves | Cams | Piston | Cylinder |
| 13 | C | C | A | B | YES | **** | **** | **** | **** | **** | *** |
| 14 | C | C | A | B | YES | **** | **** | *** | **** | **** | **** |
| 15 | C | C | A | B | YES | *** | **** | **** | **** | **** | *** |
| 16 | C | C | A | B | YES | **** | **** | **** | **** | **** | *** |

[a]Lubricants as described in Table 2.
[b]2 wt. % Lubricant B in fuel.
[c]Ratings: **Excellent; *Very Good; **Good; *Fair The main bearings, a critical region of the engine, were all in excellent condition for the 16 tested engines. Second, there was no problem with the piston ring/cylinder region; this area was also excellent. Third, the cam shaft/follower components showed absolutely no signs of wear. Again, there was slight scoring on three of the sixteen aluminum alloy connecting rod bushings but not on the corresponding ductile iron, connecting rod-crank bearing.

For comparison, six separate engine tests were conducted using the same model of engine as used in engine tests 1–16 above except according to a conventional engine pre-treatment lubricant procedure. Namely, the engine bore was sprayed with a recommended commercial pre-treatment, "run-in", oil and the piston/piston rings were coated before its assembly in the cylinder. The entire shaft of each engine was inserted in a container of a commercial EP (extreme pressure) lubricant oil and the cam shaft bearing and the recess in the cam shaft were treated by the same EP oil. All six comparison engines failed in the "hot-run" test due to excessive metal transfer and seizure at the connecting rod bearing area.

Thus, the inventive pre-treatment and lubricating compositions therefor not only provide excellent and most impressive results in these engine production tests but also demonstrated the superiority of the inventive method over conventional approaches whether compared to previous practice or other pre-treatments.

Example 3

Laboratory pin-on-disk wear tests were performed to investigate the antiwear effects of the present invention in a metal-on-metal rubbing system run under high contact stress conditions to investigate the general applicability of the invention to rubbing environments.

As to the apparatus and materials used, a pin-on-disk tester, manufactured by the Institute of Terotechnology in Radom, Poland, was used to evaluate antiwear and anti-friction properties of compounds selected for the studies. The important details of the pin-on-disk apparatus used are schematically illustrated in FIG. 2.

Experimental Procedure

Figure 2:
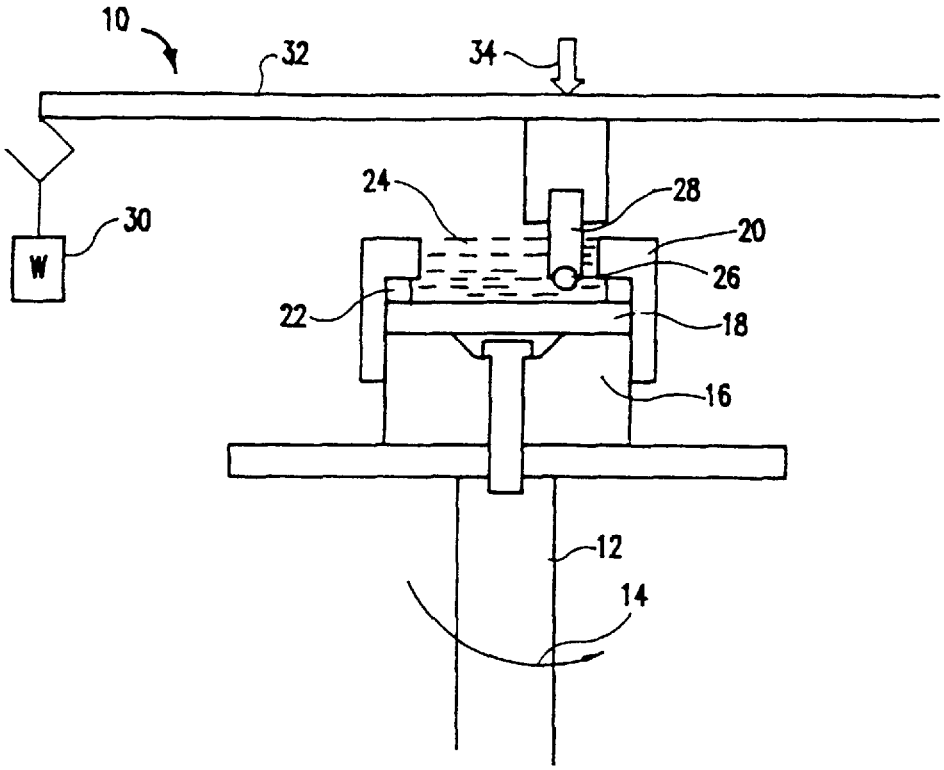
FIG. 2 is a schematic diagram showing an apparatus used to conduct liquid phase, high contact stress pin-on-disk experiments to study antiwear properties of inventive and comparison lubricants on a rubbing system.

Referring now to the drawing of the FIG. 2, there is shown a diagram of a pin-on-disk test apparatus represented generally as feature 10. The test apparatus 10 includes a table 12 capable of high speed rotation about an axis indicated by arrow 14. The speed of rotation of the table 12 can be accurately regulated by a motor controller. On the table 12 is positioned a vibration isolating platform 16 for holding a test disk 18. The vibration isolating platform 16 is a rubber material and serves to isolate adverse vibration affects from being transferred from the table 12 to the disk 18. The disk 18 is held on the vibration isolating platform 16 by a cylindrical disk holder 20. A rubber washer 22 is placed between the cylindrical disk holder 20 and the disk 18 so that a test lubricant 24 can be held in the volume created by the top portion of the cylindrical disk holder 20 which extends above the disk 18.

A test ball 26 positioned on the end of a pin 28 contacts the disk 18 during the experiments. The ball 26 is firmly secured to the pin 28 during testing by using an epoxy resin; hence, it does not rotate during the test run, rather it slides against the disk 18. Weights 30 hung on the end of a loading arm 32 exert a downward force 34 (i.e., the load) on the pin 28 which holds the ball 26 in contact with the disk 18 during a test run. The amount of downward force 34 or load is controlled by the amount of weight 30 on the loading arm 32, and for these experiments, the downward force 34 is controllable. These are very extreme test conditions which produce contact stresses which equal or exceed those existing critical tribological applications, e.g., gears, cams, and valve lifters in automotive engines, and the like. How well the lubricant 24 protects the disk 18 and the ball 26 from wear was the primary focus of this experimentation.

Several lubricant compositions 24 were studied to determine their ability to reduce the amount of wear on the disk 18 and ball 26. The tested lubricant compositions 24 involved various mixtures of the monoester and caprolactam compounds, as well as separate tests run on the pure forms of these compounds singly. The chemical structure and physical properties of the monoester and caprolactam compounds are the same as defined hereinabove for all the examples. Also, a 100 Neutral Base Oil obtained from Mobil Oil Co. was studied as a control.

In each experiment, a given amount of the tested lubricant composition 24 was placed in the volume created by the cylindrical disk holder 20 before the ball 26 was brought into contact with the disk 18. The ball 26 contacts the disk 18 at a point 8 mm from the center of the disk 18 and creates a channel in the disk 18 as it wears. The table 12 has a rotational speed of 250 revolutions per minute (rpm). The sliding velocity between the fixed ball and rotating disk was adjusted and controlled to 0.25 m/s. During each test run, the machine was started with a constant speed of 250 rpm and run until a sliding distance of the ball 26 relative to the disk 18 of 250 meters was achieved. The test load was 10 Newtons. The test balls had the following properties: 52100 steel, 0.636 mm diam., 0.0254 $\mu$m surface roughness $R_a$, and 63 HRC hardness. The test disks had the following properties: aluminum (6061-T6), 25.4 mm diam., 6 mm thick, and 0.45–0.60 $\mu$m surface roughness $R_a$. Each type of lubricant formulation was separately tested at both ambient temperature (i.e., approx. 25° C.) and at 100° C.

To prepare the test bodies for the wear experiment, both the aluminum disks and the steel balls were ultrasonically cleaned in baths of hexane and acetone for 15 minutes per liquid. Specimens were then dried and stored in sealed bottles until needed for testing.

After setting up the pin-on-disk tester apparatus and the test parameters, approximately 2 ml of a lubricant was placed in the disk-holding cup of the pin-on-disk device. The wear tests proceeded as explained above with the following qualifications. In the case of ambient-temperature studies, the tests were started immediately. In the case of 100° C. tests, software-controlled heating procedure was conducted prior to running the test. When the temperature in the lubricant cup reached the preset value, the test was started. As noted above, the tests were stopped automatically after 250 m of sliding distance.

Friction coefficient values, vertical displacement of the ball, the test chamber temperature, as well as the lubricant temperature, were continuously measured and stored by computer.

Wear of the aluminum disks was computed by the use of a "Alpha-Step" profilometer. The "Alpha-Step" profilometer characterizes a surface by scanning it with a diamond stylus. The resulting trace represented a cross-sectional view with high vertical and spatial resolution. The "Alpha-Step" profilometer has a maximum scan length of 10 mm. It has an inductive sensor that registers the vertical motion of the stylus. The stylus assembly is attached to an arm that rotates about a flexure pivot, ensuring smooth and stable movement across the scan length.

The volume of disk wear was calculated from the measured cross-sectional area of the worn track multiplied by the track circumference. The profilometer trace of the disk wear scar was taken at 4 locations on the disk, 90° C. apart.

From these traces, an average cross-sectional area of the wear scar was measured and calculated. A summary of the wear data is given in Table 5. A summary of the coefficient of friction data is given in Table 6. The mixing proportions are reported in Table 5 in weight percentages. The corresponding molar ratios are as follows: the 90 wt % monoester/10 wt % caprolactam mixture corresponds to a molar ratio of these two respective components of 1.67; the 80 wt % monoester/20 wt % caprolactam mixture corresponds to a molar ratio of these two respective components of 0.74; the 70 wt % monoester/30 wt % caprolactam mixture corresponds to a molar ratio of these two respective components of 0.43.

TABLE 5

| | Disk Volume Wear ($10^{-12}$ $m^3$) | | | | | |
|---|---|---|---|---|---|---|
| Test Temp. | BO 100 Neutral | Pure Monoester | 90% ME + 10% Capro-lactam | 80% ME + 20% Capro-lactam | 70% ME + 30% Capro-lactam | 100% Capro-lactam |
| ambient | 32.9 | 512.7 | 262.6 | 4.0 | 139.0 | (1) |
| 100° C. | 76.2 | 118.6 | 5.8 | 17.4 | 401.1 | 1472.9 |

(1) Since caprolactam was in the form of a powder at ambient temperature, this test was not conducted.

Figure 3:
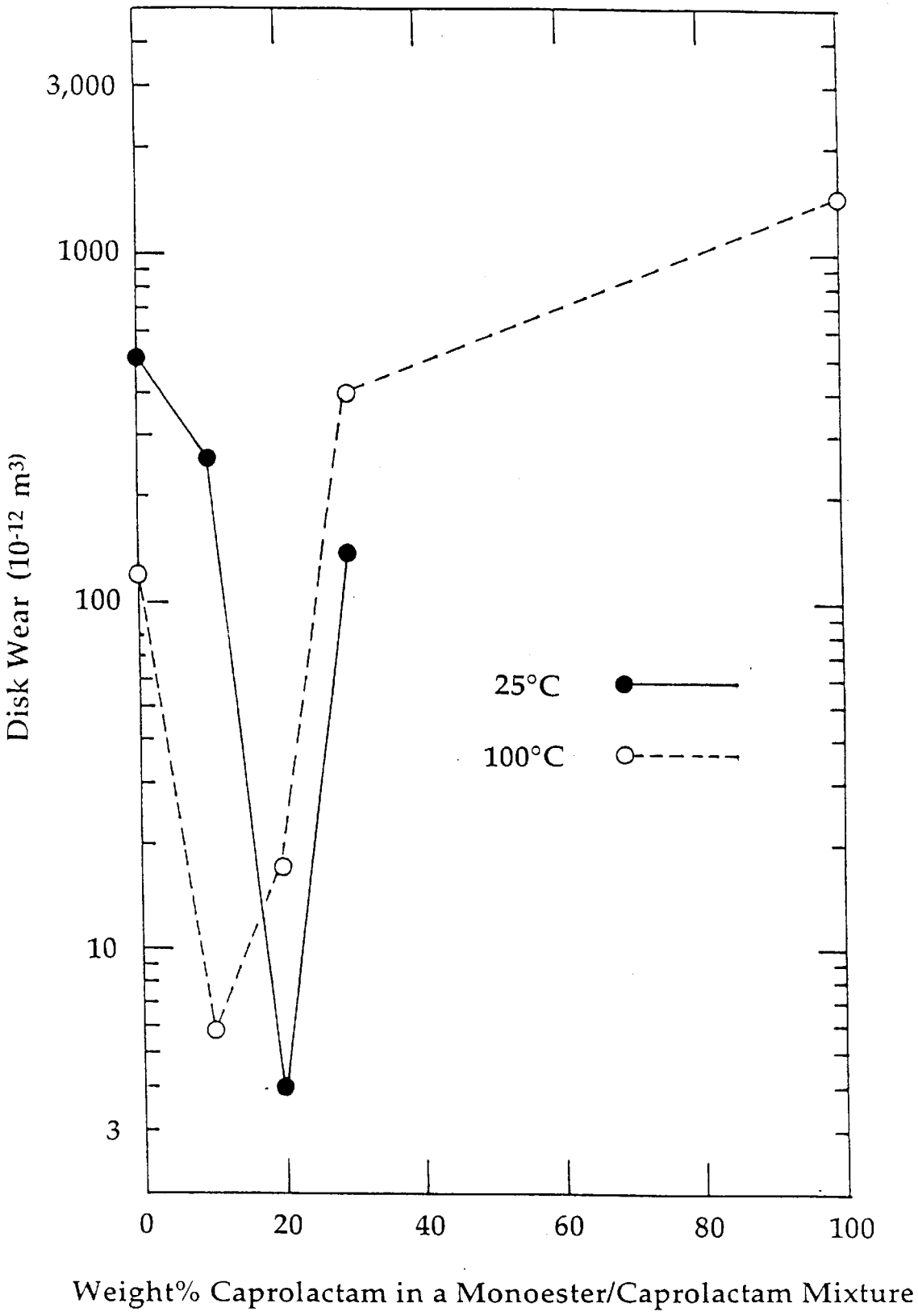
FIG. 3 is a graph showing the effect of the cyclic amide/monoester concentration ratio on wear for pin-on-disk experiments conducted in the apparatus shown in FIG. 1 for the inventive and comparison lubricants on a rubbing system at ambient temperature.

The disk wear results for the various tested formulations as reported in Table 5 are graphically illustrated in FIG. 3.

TABLE 6

| | Coefficient of Friction | | | | | |
|---|---|---|---|---|---|---|
| Test Temp. | BO 100 Neutral | Pure Monoester | 90% ME + 10% Capro-lactam | 80% ME + 20% Capro-lactam | 70% ME + 30% Capro-lactam | 100% Capro-lactam |
| ambient | 0.091 | 0.157 | 0.095 | 0.066 | 0.144 | (1) |
| 100° C. | 0.155 | 0.104 | 0.053 | 0.102 | 0.104 | 0.210 |

(1) Since caprolactam was in the form of a powder at ambient temperature, the test was not conducted.

The wear data summarized in Table 5 and depicted in FIG. 3 are extraordinary and show a strong synergistic effect of the monoester and caprolactam combination as compared to the monoester or caprolactam compounds used singly. At ambient temperature, the 80/20 combination produced an exceedingly low volumetric wear of $4(\times 10^{-12})$ $m^3$ compared to 513 for the monoester alone and approximately 33 for mineral oil. Pure caprolactam is a white crystalline powder at ambient temperature. At 100° C., the synergy was further strikingly demonstrated. The 80/20 combination of monoester and caprolactam produced only about 15% of the wear obtained with pure monoester and only slightly over 1% of the wear obtained with pure caprolactam.

Regarding the coefficient of friction results, since caprolactam is in a form of a powder at ambient temperature, the test was not conducted for that compound by itself. At ambient temperature, the initial friction obtained with pure monoester was low but after time became erratically high. The 80/20 wt %/wt % monoester/caprolactam composition produced very low and steady friction throughout the test.

At the higher test temperature (100° C.), the mineral oil reference exhibited high and erratic friction while the 80/20 mixture and pure monoester produced the lowest friction, viz., roughly half the friction value obtained with pure caprolactam.

While the invention has been described in terms of its preferred embodiments, those skilled in the art will recognize that the invention can be practiced with modification within the spirit and scope of the appended claims.

What is claimed:

1. An antiwear composition, comprising:

a cyclic amide, and a monoester formed by reaction of a dicarboxylic acid and a polyol in substantially equimolar amounts, wherein said dicarboxylic acid is a dimer of an unsaturated fatty acid.

2. The antiwear composition of claim 1, wherein said dicarboxylic acid is a $C_{36}$ dimer acid.

3. The antiwear composition of claim 2, wherein said $C_{36}$ dimer acid is a dimer of linoleic acid.

4. The antiwear composition of claim 1, wherein said polyol is a $C_2$ to $C_5$ alkane diol.

5. The antiwear composition of claim 4, wherein said alkane diol is ethylene glycol.

6. The antiwear composition of claim 1, wherein said cyclic amide is a lactam.

7. The antiwear composition of claim 6, wherein said lactam has the structural formula:

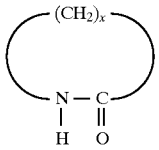

wherein x is an integer between 2 and 15.

8. The antiwear composition of claim 6, wherein said lactam is caprolactam.

9. The antiwear composition of claim 6, wherein said lactam is laurolactam.

10. The antiwear composition of claim 6, wherein said lactam is selected from the group consisting of 2-azetidinone, 2-butyrolactam, 2-azacyclohexanone, caprolactam, 2-azacyclooctanone, 2-azacyclononanone, and laurolactam.

11. An antiwear composition, comprising:

a cyclic amide, and a monoester formed by reaction of a dicarboxylic acid and a polyol in substantially equimolar amounts, wherein said dicarboxylic acid is a dimer of an unsaturated fatty acid, wherein said cyclic amide and monoester are contained in said composition in a molar ratio value of moles monoester/moles cyclic amide ranging from 0.4 to 1.8, respectively.

12. The antiwear composition of claim 11, wherein said molar ratio value of moles monoester/moles cyclic amide ranges from 0.8 to 1.2, respectively.

13. The antiwear composition of claim 11, further comprising a carrier medium throughout which said cyclic amide and said monoester are substantially uniformly dispersed or distributed.

14. The antiwear composition of claim 13, wherein said carrier medium is selected from the group consisting of a liquid, a gas, and a semi-solid.

15. The antiwear composition of claim 13, wherein said carrier medium comprises liquid hydrocarbons.

16. The antiwear composition of claim 13, wherein said carrier comprises a liquid selected from the group consisting of gasoline, jet fuel, diesel fuel, kerosene, mineral oil, and synthetic oil.

17. The antiwear composition of claim 13, wherein total amount of said cyclic amide and said monoester comprises about 0.001 to 100 wt. % of said antiwear composition.

18. A method of reducing wear between rubbing surfaces, comprising the steps of:

combining (a) cyclic amide and (b) a monoester formed by reacting a dicarboxylic acid and a polyol in substantially equimolar amounts, wherein said dicarboxylic acid is a dimer of an unsaturated fatty acid, to form an antiwear composition;

providing a first solid material having a first surface in rubbing contact with a second surface of a second solid material; and contacting said first surface with said antiwear composition in an amount effective to reduce wear of said rubbing surfaces.

19. The method of claim 18, wherein said antiwear composition comprises a molar ratio value of monoester/cyclic amide ranging from 0.4 to 1.8, respectively.

20. The method of claim 18, wherein said contacting of said first surface is provided at a time before, during, or before and during said rubbing contact.

21. The method of claim 18, wherein said cyclic amide is caprolactam.

22. The method of claim 18, wherein said first solid material and second solid material are each independently selected from the group consisting of metals, ceramics, composites, plastics, and wood.

23. A method for reducing wear in rubbing parts, comprising the steps of:

combining (a) a cyclic amide, (b) a monoester formed by reacting a dicarboxylic acid and a polyol in substantially equimolar amounts where said dicarboxylic acid is a dimer of an unsaturated fatty acid, and (c) a carrier medium, to form a lubricating composition;

providing a first solid material having a first surface which will be exposed to rubbing contact with a second surface of a second solid material;

contacting at least said first surface of said first solid material with said lubricating composition;

providing said rubbing contact between said first solid material and said second solid material, whereby said lubricating composition reduces wear and friction of at least one of said first solid material at said first surface or said second solid material at said second surface exposed to said rubbing contact.

24. The method of claim 23, wherein said cyclic amide is a lactam compound, said dicarboxylic acid is a $C_{36}$ dimer acid, and said polyol is a $C_2$ to $C_5$ alkane diol.

25. The method of claim 23, wherein said cyclic amide is dispersed or dissolved in said carrier medium.

26. The method of claim 23, wherein said carrier medium is selected from the group consisting of a liquid, a gas, and a semi-solid.

27. The method of claim 23, wherein said carrier medium is a liquid.

28. The method of claim 23, wherein said liquid is selected from the group consisting of hydrocarbon oils, mineral oils, synthetic oils, gasoline, kerosene, jet fuel, diesel fuel, polyethylene glycols, water, and aqueous polyethylene glycol solutions.

29. The method of claim 23, wherein total amount of said cyclic amide and monoester is contained in said lubricating composition comprises about 0.001 wt. % to 100 wt. %.

30. The method of claim 23, wherein said carrier medium is a gas.

31. The method of claim 23, wherein said carrier medium is a semi-solid carrier, said cyclic amide being dispersed in said semi-solid carrier.

32. The method of claim 31, wherein said semi-solid carrier is selected from the group consisting hydrocarbon grease, silicone grease, and wax.

* * * * *